US008276899B2

(12) United States Patent
Kimata et al.

(10) Patent No.: US 8,276,899 B2
(45) Date of Patent: Oct. 2, 2012

(54) MEDIA-SHEET CONVEYING UNIT

(75) Inventors: Masanobu Kimata, Aichi (JP); Yohzoh Dohki, Aichi (JP)

(73) Assignee: Ricoh Company, Limited, Tokyo (JP)

( * ) Notice: Subject to any disclaimer, the term of this patent is extended or adjusted under 35 U.S.C. 154(b) by 267 days.

(21) Appl. No.: 12/662,220

(22) Filed: Apr. 6, 2010

(65) Prior Publication Data

US 2010/0252981 A1 Oct. 7, 2010

(30) Foreign Application Priority Data

Apr. 7, 2009 (JP) ..... 2009-092980
Jan. 7, 2010 (JP) ..... 2010-001913

(51) Int. Cl.
*B65H 37/06* (2006.01)

(52) U.S. Cl. ..... 270/32; 270/39.06; 270/39.08; 493/417; 271/270; 271/203

(58) Field of Classification Search ..... 270/32, 270/39.06, 39.08, 58.12, 58.16, 58.17; 493/444, 493/445, 417; 271/270, 202, 203
See application file for complete search history.

(56) References Cited

U.S. PATENT DOCUMENTS 5,993,369 A * 11/1999 Sekita et al. ..... 493/420
6,644,654 B1 * 11/2003 Mao ..... 271/220
6,929,256 B2 * 8/2005 Kawatsu et al. ..... 270/37
7,293,766 B2 * 11/2007 Ruthenberg et al. ..... 270/37
7,712,732 B2 * 5/2010 Horii et al. ..... 270/32
7,753,353 B2 * 7/2010 McNamara ..... 270/37
7,900,899 B2 * 3/2011 Kawaguchi ..... 270/37
7,934,714 B2 * 5/2011 Ichihashi et al. ..... 270/58.17
7,946,569 B2 * 5/2011 Suzuki et al. ..... 270/58.12
2006/0180970 A1 * 8/2006 Mimura et al. ..... 270/32
2007/0176357 A1 8/2007 Horio et al.
2007/0290427 A1 * 12/2007 Horii et al. ..... 270/32
2009/0062100 A1 3/2009 Takekawa et al.
2009/0129840 A1 5/2009 Takekawa et al.

FOREIGN PATENT DOCUMENTS

JP 2001-206629 7/2001
JP 2001-302089 10/2001
JP 2007-320665 12/2007

* cited by examiner

*Primary Examiner* — Patrick Mackey
(74) *Attorney, Agent, or Firm* — Harness, Dickey & Pierce, P.L.C.

(57) ABSTRACT

A media-sheet post-processing apparatus performs post-processing on a media sheet delivered thereto. The sheet media post-processing apparatus includes a media-sheet conveying unit configured to convey a media sheet while moving in a media-sheet conveying direction; and a move drive unit configured to move the media-sheet conveying unit in the media-sheet conveying direction in such a manner that a difference between an amount that the media sheet is conveyed by the media-sheet conveying unit and an amount that the media-sheet conveying unit is moved is kept constant.

15 Claims, 6 Drawing Sheets

Z-FOLD

SINGLE FOLD

LETTER FOLD-OUT

LETTER FOLD-IN

DOUBLE PARALLEL FOLD

CLOSED-GATE FOLD

MEDIA-SHEET CONVEYING UNIT

CROSS-REFERENCE TO RELATED APPLICATIONS

The present application claims priority to and incorporates by reference the entire contents of Japanese Patent Application No. 2009-092980 filed in Japan on Apr. 7, 2009 and Japanese Patent Application No. 2010-001913 filed in Japan on Jan. 7, 2010.

BACKGROUND OF THE INVENTION

1. Field of the Invention

The present invention is directed generally to a media-sheet post-processing apparatus that performs post-processing on a media sheet delivered thereto and an image forming apparatus that includes the media-sheet post-processing apparatus.

2. Description of the Related Art

In recent years, sheet processing systems that includes a media-sheet post-processing apparatus and an image forming apparatus, such as a copying machine or a printer, that are arranged adjacent to each other so that the media-sheet post-processing apparatus can align the sheets delivered from the image forming apparatus into a set of sheets and then perform stapling and/or hole punching of the sets of sheets have proliferated.

Various techniques for allowing such a media-sheet post-processing apparatus to provide favorable sheet processing have conventionally been devised and employed.

For instance, Japanese Patent Application Laid-open No. 2001-206629 discloses a technique of pinching a set of sheets, in its thickness direction, between rollers provided on a pivotable guide plate, thereby preventing the set of sheets from going out of alignment.

Japanese Patent Application Laid-open No. 2001-302089 discloses a technique of pinching a set of sheets between one of a pair of folding rollers for use in sheet fold and an upstream roller and between the other roller of the folding rollers and a downstream roller to thereby preventing sheets in the set from going out of alignment.

The applicant has proposed a configuration, in an unexamined application (Japanese Patent Application No. 2008-294436), in which after a set of sheets is stacked in a sheet prestack unit, a retaining member is moved to a trailing end portion of the sheets so that the sheets are folded while being pressed by the retaining member.

In the technique described in the unexamined application, when a set of sheets is prestacked in the sheet prestack unit, the retaining member is moved up or down to press the set of sheets at the trailing end portion so that the set of sheets is stacked without fail.

In an attempt of increasing speed at which sheets are processed in an image forming apparatus, intervals between sheets conveyed in the image forming apparatus are generally reduced. However, it is necessary to suspend sheet conveyance during a period of the up or down movement of the retaining member, which has been a bottleneck in speedup of post-processing.

SUMMARY OF THE INVENTION

It is an object of the present invention to at least partially solve the problems in the conventional technology.

According to an aspect of the present invention, there is provided a media-sheet post-processing apparatus that performs post-processing on a media sheet delivered thereto. The sheet media post-processing apparatus includes a media-sheet conveying unit configured to convey a media sheet while moving in a media-sheet conveying direction; and a move drive unit configured to move the media-sheet conveying unit in the media-sheet conveying direction in such a manner that a difference between an amount that the media sheet is conveyed by the media-sheet conveying unit and an amount that the media-sheet conveying unit is moved is kept constant.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings.

Figure 1:
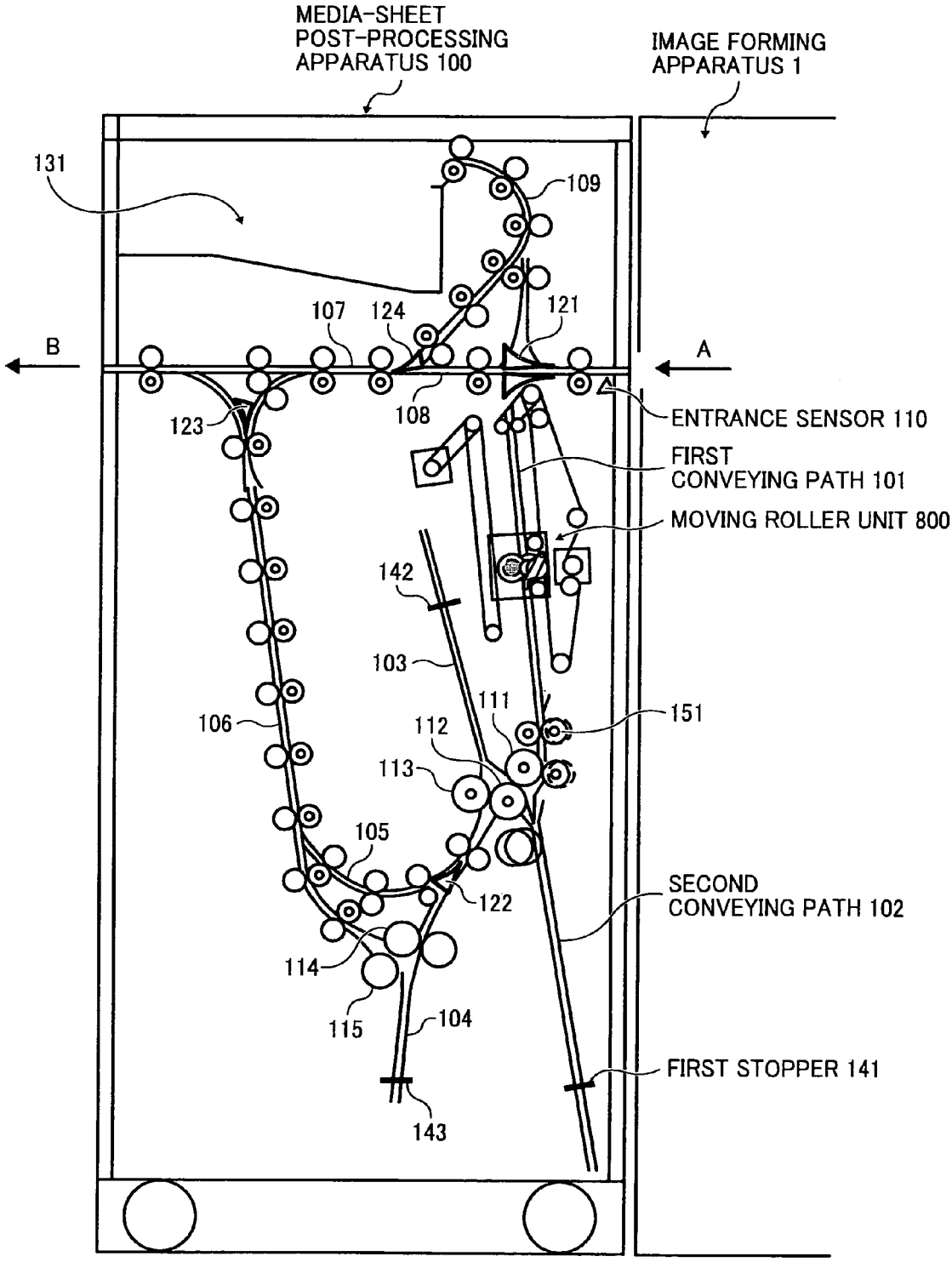
FIG. 1 is a schematic general view illustrating a layout of a media-sheet post-processing apparatus according to an embodiment of the present invention.
Figure 2:
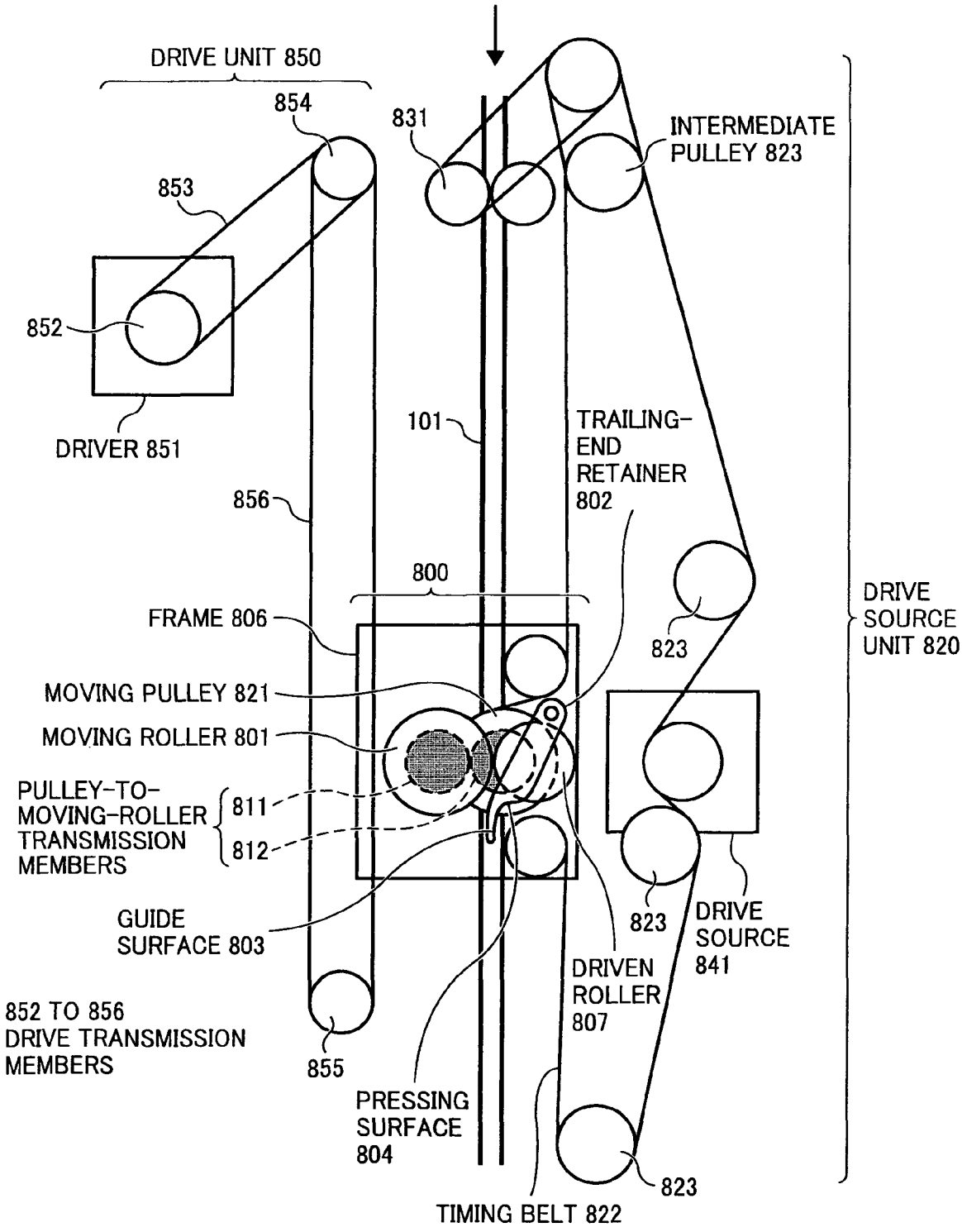
FIG. 2 is an enlarged schematic view of relevant parts of the media-sheet post-processing apparatus according to the embodiment.

FIG. 1 is a schematic general view illustrating a layout of a media-sheet post-processing apparatus according to an embodiment of the present invention. FIG. 2 is an enlarged schematic view of relevant parts of the media-sheet post-processing apparatus according to the embodiment.

Referring to FIG. 1, reference numeral 1 denotes an image forming apparatus, which is a host apparatus and from which a sheet is to be delivered, and 100 denotes a media-sheet post-processing apparatus that receives the sheet delivered from the image forming apparatus 1, which is arranged on a right-hand side of FIG. 1, in a direction indicated by arrow A. The image forming apparatus 1 has a known configuration and includes a sheet conveyance path, an image forming unit that forms an image on the sheet, and a sheet delivery unit that delivers the sheet, on which an image has been formed, in the direction indicated by arrow A.

In the media-sheet post-processing apparatus 100 illustrated in FIG. 1, reference numerals 101 to 109 denote a plurality of (in this example, nine) sheet conveying paths provided for sheet conveyance or to perform various folding operations. Reference numerals 111 to 115 denote a plurality of (in this example, five) sheet folding rollers, that are specifically referred to as a first folding roller, a second folding roller, a third folding roller, a fourth folding roller, and a fifth folding roller, each of which is arranged at a corresponding position so as to perform sheet folding operation at the position.

Reference numerals 121 to 124 denote a plurality of (in this example, four) path-switching flaps, specifically referred to as a first path-switching flap, a second path-switching flap, a third path-switching flap, and a fourth path-switching flap, each of which is arranged at a corresponding position, at which the conveying paths are branched, and pivotable for switching between the conveyance paths. Reference numeral 131 denotes a sheet output unit, into which sheets are to be output, arranged in an upper portion of the apparatus, and 141 to 143 denote a plurality of (in this example, three) stopper members, specifically referred to as a first stopper, a second stopper, and a third stopper that are provided on the second conveying path 102, the third conveying path 103, and the fourth conveying path 104, respectively, to stop movement of a sheet on a corresponding one of the conveying paths.

With the configuration according to the embodiment mentioned above, various folding operations including single hold, Z-fold, letter fold-out, letter fold-in, double parallel fold, and closed-gate fold can be performed.

In the embodiment, when folding operation is not to be performed, a sheet delivered to the media-sheet post-processing apparatus 100, in which the first path-switching flap 121 is oriented horizontally, is conveyed on the eighth conveying path 108 and the seventh conveying path 107, which are arranged on a left-side portion of FIG. 1, and output in a direction indicated by arrow B through a sheet output port.

When folding operation is to be performed, a sheet is guided to one of corresponding conveying paths inside media-sheet post-processing apparatus 100 by the first path-switching flap 121 to undergo one of the following folding operations.

<Z-Fold>

The first path-switching flap 121 guides a sheet to the first conveying path 101. On the first conveying path 101, the sheet is guided by a guide member (not shown) that is arranged in and retractable from a nip portion between the first folding roller 111 and the second folding roller 112 to be fed into and then out of the nip between the first folding roller 111 and the second folding roller 112 and conveyed until a leading end of the sheet abuts on the second stopper 142 that has been moved to a predetermined folding position on the third conveying path 103.

Figure 6A:
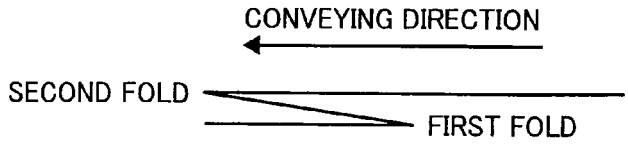
FIGS. 6A to 6F are schematic views illustrating how folding operations according to the embodiment are performed.

A portion of the sheet abutted on the on the second stopper 142 is resiliently deformed and fed into a nip between the second folding roller 112 and the third folding roller 113, causing the sheet to be subjected to first fold. Thereafter, the sheet is conveyed to the fourth conveying path 104 by being guided by the second path-switching flap 122. The leading end of the sheet is brought into abutment on the third stopper 143 that has been moved to a predetermined folding position on the fourth conveying path 104. A portion of the sheet is resiliently deformed and fed into a nip between the fourth folding roller 114 and the fifth folding roller 115, causing the sheet to be subjected to second fold, with which Z-fold is completed (FIG. 6A).

The sheet having undergone the folding operation mentioned above is conveyed through the sixth conveying path 106 and guided to the seventh conveying path 107 by the third path-switching flap 123. The sheet is further guided to the ninth conveying path 109 by the fourth path-switching flap 124 to be stacked in the sheet output unit 131. If the sheet is to be delivered to outside of the apparatus, the third path-switching flap 123 switches a conveying direction to deliver the sheet to the outside of the apparatus.

<Single Fold>

Figure 6B:
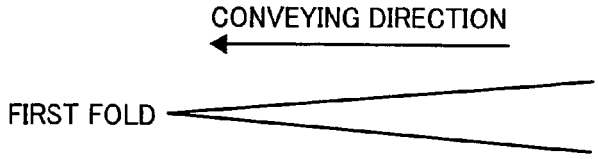

The first path-switching flap 121 guides a sheet to the first conveying path 101. A leading end of the sheet is brought into abutment on the first stopper 141 on the second conveying path 102. A portion of the sheet is resiliently deformed and fed into the nip between the first folding roller 111 and the second folding roller 112, causing the sheet to be folded to complete single fold (FIG. 6B).

The thus-single-folded sheet is guided by a guide member (not shown) to be fed into the nip between the second folding roller 112 and the third folding roller 113, rather than onto the third conveying path 103, and then guided to the fifth conveying path 105 by the second path-switching flap 122. The single-folded sheet is further conveyed through the sixth conveying path 106, guided to the seventh conveying path 107 by the third path-switching flap 123, and further guided to the ninth conveying path 109 by the fourth path-switching flap 124 to be stacked in the sheet output unit 131. If the sheet is to be delivered to the outside of the apparatus, the third path-switching flap 123 switches the conveying direction to deliver the sheet to the outside of the apparatus.

<Letter Fold-Out, Letter Fold-In, and Double Parallel Fold>

The first path-switching flap 121 guides a sheet to the first conveying path 101. A leading end of the sheet is brought into abutment on the first stopper 141 on the second conveying path 102. A portion of the sheet is resiliently deformed and fed into the nip between the first folding roller 111 and the second folding roller 112, causing the sheet to be subjected to first fold. Thereafter, the sheet is conveyed to the third conveying path 103.

Figure 6C:
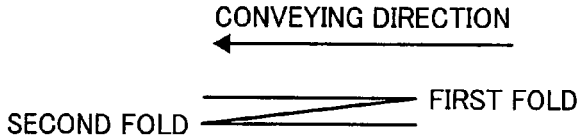
Figure 6D:
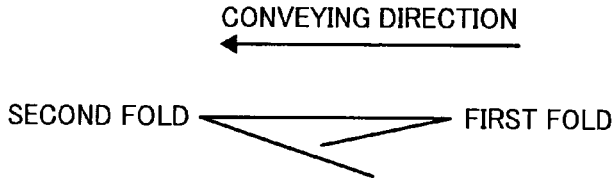
Figure 6E:
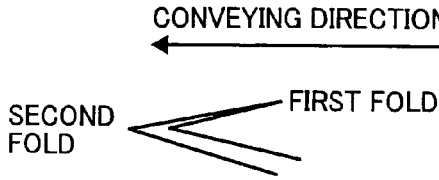

The leading end of the sheet is brought into abutment on the second stopper 142 on the third conveying path 103. A portion of the sheet is resiliently deformed and fed into the nip between the second folding roller 112 and the third folding roller 113, causing the sheet to be subjected to second fold, with which folding of the sheet is completed (FIGS. 6C, 6D, and 6E).

The sheet having undergone the folding is guided to the fifth conveying path 105 by the second path-switching flap 122, conveyed through the sixth conveying path 106, and guided to the seventh conveying path 107 by the third path-switching flap 123. The sheet is further guided to the ninth conveying path 109 by the fourth path-switching flap 124 to be stacked in the sheet output unit 131. If the sheet is to be delivered to the outside of the apparatus, the third path-switching flap 123 switches the conveying direction to deliver the sheet to the outside of the apparatus.

<Closed-Gate Fold>

The first path-switching flap 121 guides a sheet to the first conveying path 101. A leading end of the sheet is brought into abutment on the first stopper 141 on the second conveying path 102. A portion of the sheet is resiliently deformed and fed into the nip between the first folding roller 111 and the second folding roller 112, causing the sheet to be subjected to first fold. Thereafter, the sheet is conveyed to the third conveying path 103.

The leading end of the sheet is brought into abutment on the second stopper 142 on the third conveying path 103. A portion of the sheet is resiliently deformed and fed into the nip between the second folding roller 112 and the third folding roller 113, causing the sheet to be subjected to second fold. Thereafter, the sheet is conveyed to the fourth conveying path 104 by being guided by the second path-switching flap 122.

Figure 6F:
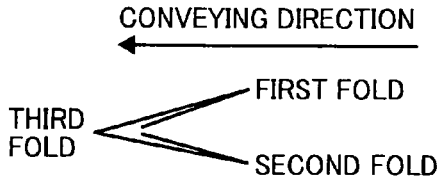

The leading end of the sheet is brought into abutment on the third stopper 143 that has been moved to a predetermined folding position on the fourth conveying path 104. A portion of the sheet is resiliently deformed and fed into the nip between the fourth folding roller 114 and the fifth folding roller 115, causing the sheet to be subjected to third fold to complete closed-gate fold (FIG. 6F).

When the leading end of the sheet is brought into abutment on the third stopper 143 on the fourth conveying path 104, by which the resiliently deformed portion of the sheet is fed into the nip between the fourth folding roller 114 and the fifth folding roller 115, a gate-fold guide member (not shown) is operated so that the end portion, at which the sheet is to be caught in the nip, advances into the nip between the fourth folding roller 114 and the fifth folding roller 115 without fail.

The sheet that has been folded is conveyed through the sixth conveying path 106, guided to the seventh conveying path 107 by the third path-switching flap 123, and further guided to the ninth conveying path 109 by the fourth path-switching flap 124 to be stacked in the sheet output unit 131. If the sheet is to be delivered to the outside of the apparatus, the third path-switching flap 123 switches the conveying direction to deliver the sheet to the outside of the apparatus.

The configuration of a media-sheet conveying unit in the media-sheet post-processing apparatus will be described below with reference to FIG. 1 and FIG. 2.

Trailing-end retaining is performed during prestacking, which is an operation of stacking sheets on one another to be performed by the media-sheet conveying unit according to the present embodiment. The prestacking of stacking sheets on one another is performed on the first conveying path 101 and the second conveying path 102, which serves as a sheet prestack path.

On the first conveying path 101, a moving roller unit 800 that conveys a sheet to the first stopper 141 and a drive unit 850 that is a move drive unit that moves the moving roller unit 800 up or down in the conveying direction are provided.

The moving roller unit 800 includes a moving roller 801 that is a conveying member that conveys a sheet while moving in the sheet conveying direction, a driven roller 807 that comes into press contact with the moving roller 801 to be rotated by rotation of the moving roller 801, a trailing-end retainer 802 that is a sheet retaining member that aligns prestacked sheets in the sheet conveying direction, and a frame 806 that is a holding member that holds the moving roller 801 and the trailing-end retainer 802.

The trailing-end retainer 802 is pivotably provided on the frame 806 and includes, at a downstream end of the trailing-end retainer 802 in the conveying direction, a guide surface 803 that guides a sheet being conveyed and a pressing surface 804 that is to come into press contact with a trailing end of a set of prestacked media sheets. The trailing-end retainer 802 is urged clockwise by a tension spring, which will be described later.

The moving roller 801 is rotated by a drive source unit 820 that includes a drive transmission unit and a drive source. The drive source unit 820 includes a drive source 841 that includes a motor or the like, a moving pulley 821, a timing belt 822, a plurality of intermediate pulleys 823, and pulley-to-moving-roller transmission members 811 and 812 (in this example, two gears), where at least the moving pulley 821 and the pulley-to-moving-roller transmission members 811 and 812 are provided on the frame 806.

In this example, the media-sheet conveying unit is configured such that the drive source 841 is held by an apparatus body frame (not shown) that holds various units of the apparatus; the timing belt 822 extends along a moving direction of the moving roller unit 800; the diameter of the moving roller 801 is equal to the pitch circle diameter of the moving pulley 821; and a rotation speed ratio between the pulley-to-moving-roller transmission members 811 and 812 is "1."

The drive unit 850 includes a driver 851, which includes a drive motor, and drive transmission members 852 to 856, which are pulleys and belts, where at least the driver 851 is held by the apparatus body frame (not shown).

Because the media-sheet conveying unit is constructed as discussed above, when the drive unit 850 moves the moving roller unit 800 up or down, the moving pulley 821 is rotated by the timing belt 822 meshed with the moving roller unit 800. Because the diameter of the moving roller 801 and the pitch circle diameter of the moving pulley 821 are set to be equal to each other and the rotation ratio between the pulley-to-moving-roller transmission members 811 and 812 is set to (1:1), during a period where the drive source 841 is stopped (V=0), moving velocity V0 of the moving roller unit 800 and tangential velocity V1 at the diameter of the moving roller 801 (sheet delivery speed) is equal to each other (V0=V1).

The media-sheet conveying unit is configured such that while the drive source 841 is driven, a sheet conveying speed V is kept constant irrespective of the moving velocity V0 of the moving roller unit 800 and there holds an equation V=V1−V0 (when the moving roller unit is moving in the opposite direction, V=V1+V0), where V1 is the conveying velocity of the moving roller 801.

In the embodiment, the diameter of the moving roller 801 and the pitch circle diameter of the moving pulley 821 are set to be equal to each other (1:1); however, the ratio is not limited thereto but can be any ratio so long as, while the drive source unit 820 is stopped, the moving velocity V0 of the moving roller unit 800 and the tangential velocity V1 at the diameter of the moving roller 801 are equal to each other (V0=V1). Accordingly, any ratio can be employed so long as the ratio between the diameter of the moving roller 801 and the pitch circle diameter of the moving pulley 821 is equal to the rotation speed ratio between the pulley-to-moving-roller transmission members 811 and 812.

When the diameter of the moving roller 801 and the pitch circle diameter of the moving pulley 821 are set to be equal to each other, a rotary axis of the moving roller 801 and a rotary axis of the moving pulley 821 can be coaxially arranged, by which the need of providing the pulley-to-moving-roller transmission members 811 and 812 can be eliminated.

Operations related to relevant parts of the embodiment will be described with reference to FIGS. 3A to 3E that illustrate the schematic views of the operations of the relevant parts and FIG. 4, in which the timing diagram is illustrated.

Stack folding, or folding a prestacked set of sheets, is performed when a plurality of sheets having been stacked on one another on the first conveying path 101 and the second conveying path 102 are subjected to one of various folding operations.

Figure 3A:
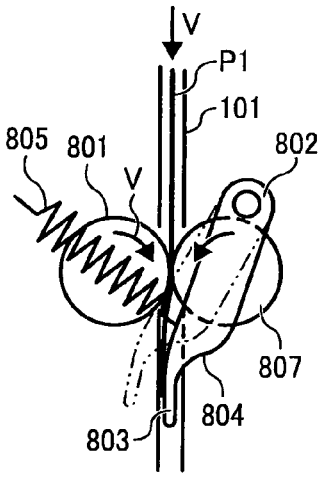
FIGS. 3A to 3E are schematic views illustrating operations of relevant parts according to the embodiment.
Figure 3B:
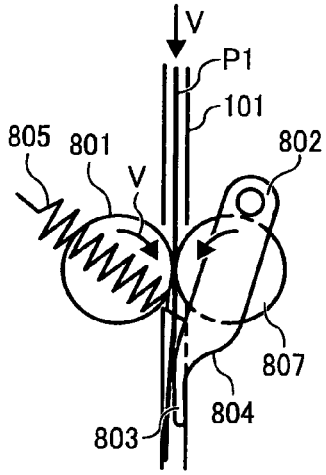

A first sheet P1 delivered from the image forming apparatus 1 is detected by an entrance sensor 110, guided to the first conveying path 101 by the first path-switching flap 121, and conveyed by a carriage roller 831 illustrated in FIG. 2. When the first sheet P1 is fed to the moving roller unit 800, as illustrated in FIG. 3A, a leading end of the sheet comes into abutment on the guide surface 803 of the trailing-end retainer 802. The first sheet P1 is conveyed against spring tension of a tension spring 805 as illustrated in FIG. 3B to the second conveying path 102 serving as the media-sheet prestack path.

Figure 3C:
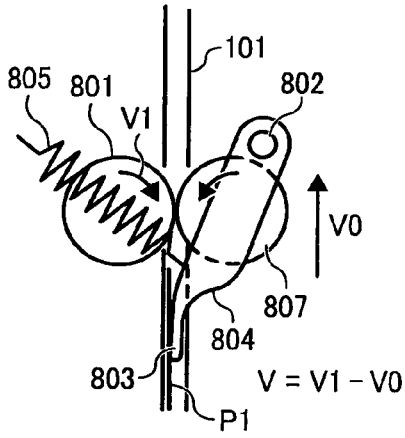

The first sheet P1 is further conveyed to reach a point where a trailing end of the first sheet P1 has passed by the guide surface 803 of the trailing-end retainer 802. Before the first sheet P1 reaches the point, the drive unit 850 moves the moving roller unit 800 up as illustrated in FIG. 3C. When the first sheet P1 is further conveyed and reaches the point where the trailing end of the first sheet P1 has passed by the guide surface 803 of the trailing-end retainer 802, the first sheet P1 slips down under its own weight onto the first stopper 141 on the second conveying path 102. At this point in time, the moving roller unit 800 stops.

Figure 3D:
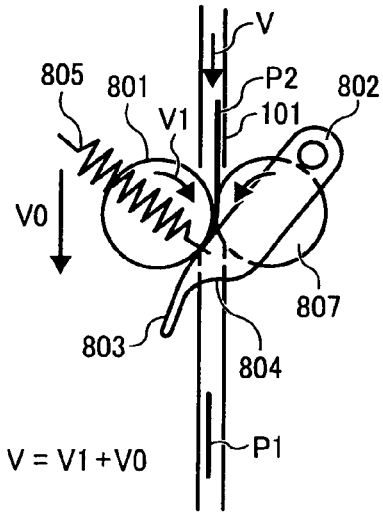

Moving the moving roller unit 800 down is performed in a state where a second sheet P2, which a subsequent sheet, has already been fed to the moving roller unit 800. As illustrated in FIG. 3D, the second sheet P2 is brought into abutment at its leading end with the guide surface 803 of the trailing-end retainer 802 and conveyed against spring tension of the tension spring 805.

Figure 3E:
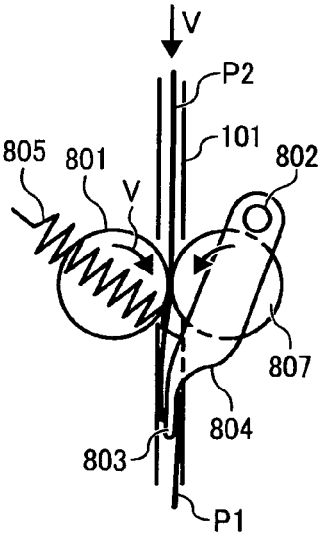

When the leading end of the second sheet P2 reaches a leading end of the guide surface 803 of the trailing-end retainer 802, the trailing end of the first sheet P1 has been covered with the guide surface 803 of the trailing-end retainer 802 as illustrated in FIG. 3E. This allows to perform conveyance without bringing the leading end of the second sheet P2 into abutment with the trailing end of the first sheet P1.

Thereafter, the second sheet P2 is further conveyed to reach a point where a trailing end of the second sheet P2 has passed by the guide surface 803 of the trailing-end retainer 802. Before the second sheet P2 reaches the point, the drive unit 850 moves the moving roller unit 800 up. When the trailing end of the second sheet P2 has passed by the guide surface 803 of the trailing-end retainer 802, the second sheet P2 slips down under its own weight onto the first stopper 141 on the second conveying path 102. At this point in time, the moving roller unit 800 stops.

Similar timing of activating the moving roller unit 800 is employed to perform prestacking of a third sheet P3.

Figure 4:
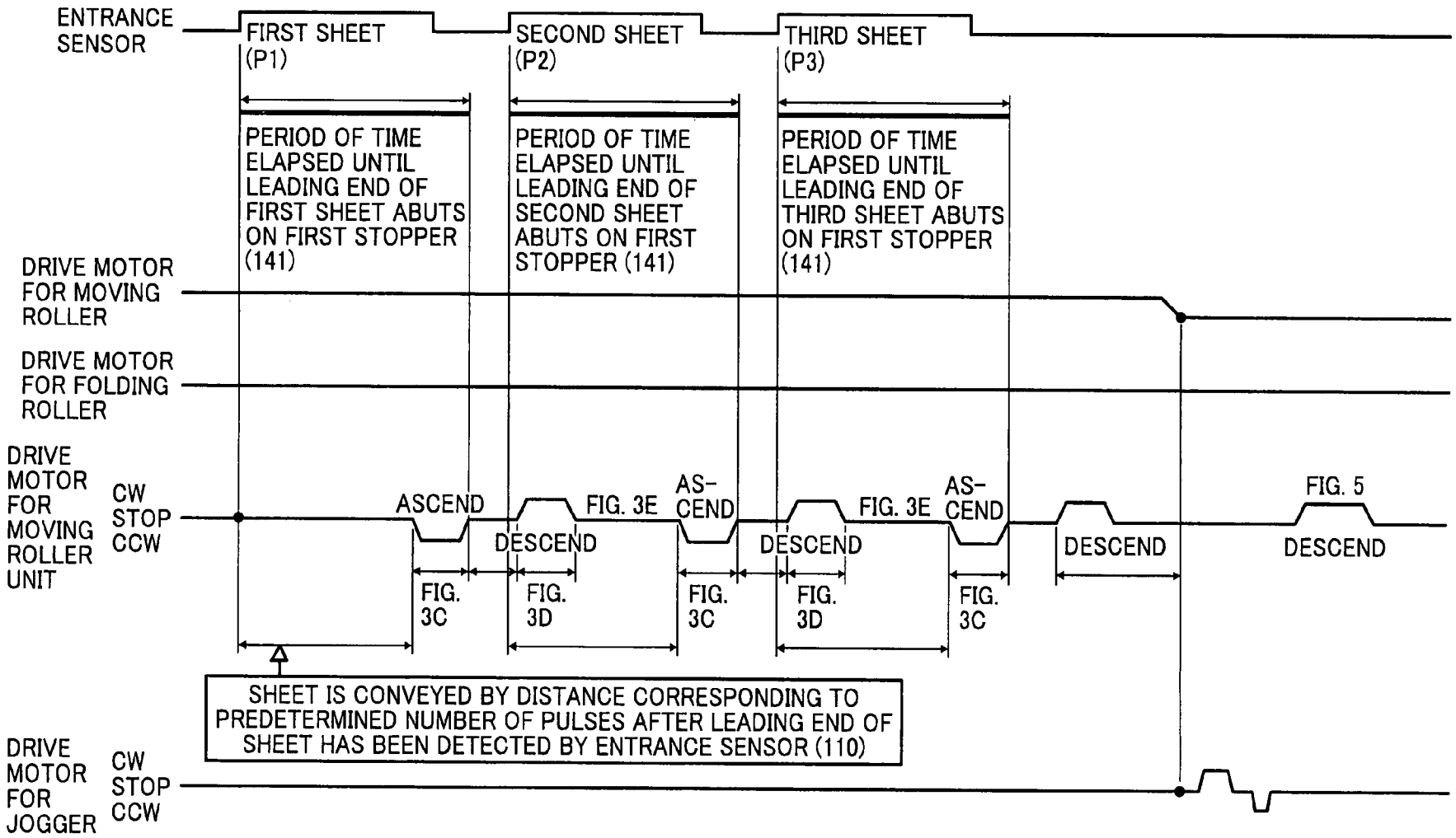
FIG. 4 is a timing chart related to folding operation according to the present embodiment.
Figure 5:
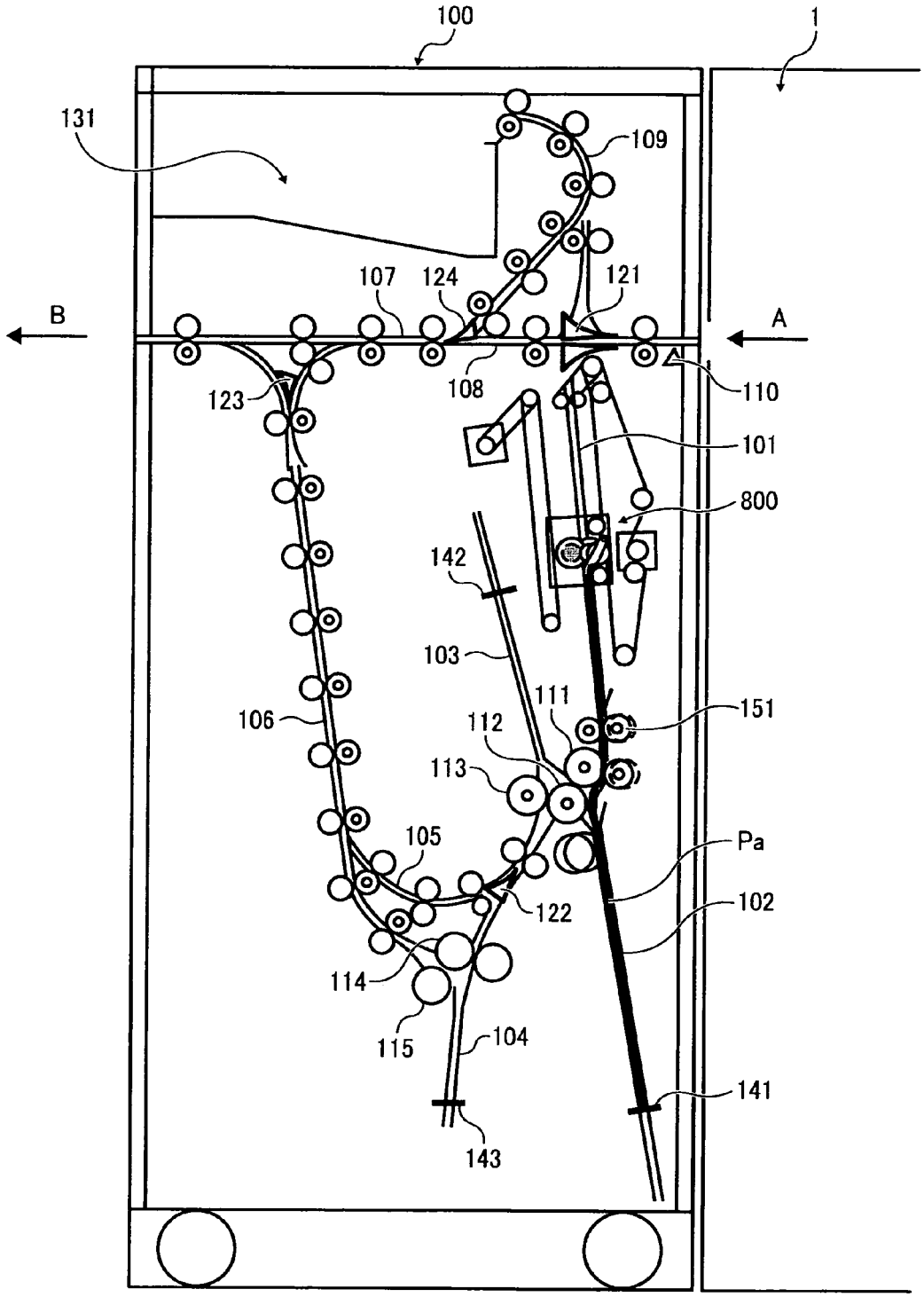
FIG. 5 is a schematic configuration diagram of relevant parts that are performing folding operation according to the present embodiment.

After the prestacking is completed, alignment of sheets in sheet width direction is performed by a jogger (not shown) at a timing point for driving the jogger illustrated in FIG. 4. The pressing surface 804 of the trailing-end retainer 802 performs alignment in the sheet conveying direction while pushing the sheets in the sheet conveying direction. A set of sheets Pa is resiliently deformed as illustrated in FIG. 5 so that the set of sheets is caught in the nip between the first folding roller 111 and the second folding roller 112, causing the set of sheet to be subjected to folding operation.

In the embodiment, the configuration example where the media-sheet post-processing apparatus independent from the image forming apparatus is provided outside the image forming apparatus and receives a sheet delivered from the image forming apparatus. Alternatively, another configuration, in which a sheet loading apparatus that has the configuration discussed above and serves as the media-sheet post-processing apparatus is incorporated inside the image forming apparatus, can be employed.

According to an aspect of the present invention, a media-sheet post-processing apparatus that performs post-processing on a media sheet delivered thereto includes a media-sheet conveying unit configured to convey a media sheet while moving in a media-sheet conveying direction; and a move drive unit configured to move the media-sheet conveying unit in the media-sheet conveying direction in such a manner that a difference between an amount that the media sheet is conveyed by the media-sheet conveying unit and an amount that the media-sheet conveying unit is moved is kept constant. With this construction, linear velocity is kept constant even during movement of the media-sheet conveying unit, which saves waiting time during the movement and leads to speedup of media-sheet post-processing.

Preferably, the media-sheet conveying unit may include a conveying member that conveys a media sheet; a drive source unit that drives the conveying member and is arranged on a holding member, the holding member being provided on a main body of the apparatus and holding various units; and a drive transmission unit that transmits driving force from the drive source unit to the conveying member. With this construction, installation of the drive source unit is facilitated.

Preferably, the conveying member may include a carriage roller and a driven roller to be rotated by rotation of the carriage roller. With this construction, the media sheet can be conveyed reliably by the carriage roller and the driven roller.

Preferably, the drive transmission unit may include a timing belt and a pulley that comes into engagement with the timing belt. With this construction, the drive transmission unit can have a simpler configuration than that of the drive-power transmission mechanism that includes a set of gears.

Preferably, the pulley and the carriage roller may be designed such that a ratio between a pitch circle diameter of the pulley and a diameter of the carriage roller is equal to a rotation speed ratio between the pulley and the carriage roller. With this construction, linear velocity can be kept constant without special control irrespective of a moving velocity of the carriage roller.

Preferably, the diameter of the carriage roller may be equal to the pitch circle diameter of the pulley. With this construction, setting a rotation speed ratio to "1" can be attained with a simple configuration.

Preferably, a rotary axis of the carriage roller and a rotary axis of the pulley may be coaxially arranged. With this construction, it is not necessary to provide a transmission unit between the carriage roller and the pulley any more.

Preferably, the media-sheet post-processing apparatus may further includes a plurality of folding rollers that perform folding operation on the media sheet; a media-sheet prestack path that is provided downstream of the folding rollers and capable of receiving and stacking the plurality of media sheets thereon; a stopper that comes into contact with leading ends of media sheets delivered onto the media-sheet prestack path to block the media sheets; and a media-sheet retaining member that is pivotable in the media-sheet conveying direction and that comes into contact with trailing ends of the media sheets whose leading ends are in contact with the stopper and blocked, to thereby align the media sheets. With this construction, a set of sheets can be stacked on the media-sheet prestack path invariably, which leads to favorable fold of the set of sheets.

Preferably, the folding operation may be performed by pressing the trailing ends of the media sheets whose leading ends are in contact with the stopper and blocked, with the media-sheet retaining member to cause a portion of the set of media sheets to be resiliently deformed, and feeding the portion of the set of media sheets that is resiliently deformed into a nip between the folding rollers. With this construction, favorable fold can be made.

Preferably, the conveying member and the media-sheet retaining member may be simultaneously movable in the media-sheet conveying direction. With this construction. because the media sheet can be conveyed at a constant velocity even while the conveying member and the media-sheet retaining member are moved up or down, even media sheets having relatively-small intervals therebetween can be stacked. This leads to high-speed stacking.

Preferably, the conveying member and the media-sheet retaining member may be held by a single holding member, and the holding member may be movable only in the media-sheet conveying direction. With this construction, because the conveying member and the sheet-medium retaining member are held by the single holding member, a drive mechanism and/or the like can be simplified.

According to another aspect of the present invention, an image forming apparatus includes the media-sheet post-processing apparatus according to the present invention. Accordingly, the post-processing on the media sheet having undergone image processing can be performed invariably and at a high speed, which increases reliability of the apparatus.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A media-sheet post-processing apparatus that performs post-processing on a media sheet delivered thereto, the sheet media post-processing apparatus comprising:

a media-sheet conveying unit configured to convey a media sheet while moving in a media-sheet conveying direction, the media-sheet conveying unit includes:

a conveying member that conveys a media sheet;

a drive source unit that drives the conveying member and is arranged on a holding member, the holding member being provided on a main body of the apparatus and holding various units; and a drive transmission unit that transmits driving force from the drive source unit to the conveying member; and a move drive unit configured to move the media-sheet conveying unit in the media-sheet conveying direction in such a manner that a difference between an amount that the media sheet is conveyed by the media-sheet conveying unit and an amount that the media-sheet conveying unit is moved is kept constant.

2. The media-sheet post-processing apparatus according to claim 1, wherein the conveying member includes a carriage roller and a driven roller to be rotated by rotation of the carriage roller.

3. The media-sheet post-processing apparatus according to claim 2, wherein the pulley and the carriage roller are designed such that a ratio between a pitch circle diameter of the pulley and a diameter of the carriage roller is equal to a rotation speed ratio between the pulley and the carriage roller.

4. The media-sheet post-processing apparatus according to claim 3, wherein the diameter of the carriage roller is equal to the pitch circle diameter of the pulley.

5. The media-sheet post-processing apparatus according to claim 4, wherein a rotary axis of the carriage roller and a rotary axis of the pulley are coaxially arranged.

6. The media-sheet post-processing apparatus according to claim 1, wherein the drive transmission unit includes a timing belt and a pulley that comes into engagement with the timing belt.

7. The media-sheet post-processing apparatus according to claim 6, wherein the pulley and the carriage roller are designed such that a ratio between a pitch circle diameter of the pulley and a diameter of the carriage roller is equal to a rotation speed ratio between the pulley and the carriage roller.

8. The media-sheet post-processing apparatus according to claim 7, wherein the diameter of the carriage roller is equal to the pitch circle diameter of the pulley.

9. The media-sheet post-processing apparatus according to claim 8, wherein a rotary axis of the carriage roller and a rotary axis of the pulley are coaxially arranged.

10. The media-sheet post-processing apparatus according to claim 1, further comprising:

a plurality of folding rollers that perform folding operation on the media sheet;

a media-sheet prestack path that is provided downstream of the folding rollers and capable of receiving and stacking the plurality of media sheets thereon;

a stopper that comes into contact with leading ends of media sheets delivered onto the media-sheet prestack path to block the media sheets; and a media-sheet retaining member that is pivotable in the media-sheet conveying direction and that comes into contact with trailing ends of the media sheets whose leading ends are in contact with the stopper and blocked, to thereby align the media sheets.

11. The media-sheet post-processing apparatus according to claim 10, wherein the folding operation is performed by pressing the trailing ends of the media sheets whose leading ends are in contact with the stopper and blocked, with the media-sheet retaining member to cause a portion of the set of media sheets to be resiliently deformed, and feeding the portion of the set of media sheets that is resiliently deformed into a nip between the folding rollers.

12. The media-sheet post-processing apparatus according to claim 10, wherein the conveying member and the media-sheet retaining member are simultaneously movable in the media-sheet conveying direction.

13. The media-sheet post-processing apparatus according to claim 10, wherein the conveying member and the media-sheet retaining member are held by a single holding member, and the holding member is movable only in the media-sheet conveying direction.

14. An image forming apparatus comprising:

an image forming unit;

a conveying unit that conveys a media sheet, on which an image has been formed by the image forming unit;

a media-sheet post-processing unit that performs post-processing on the media sheet delivered from the conveying unit; and the media-sheet post-processing apparatus according to claim 1.

15. A media-sheet post-processing apparatus that performs post-processing on a media sheet delivered thereto, the sheet media post-processing apparatus comprising:

a media-sheet conveying unit configured to convey a media sheet while moving in a media-sheet conveying direction;

a move drive unit configured to move the media-sheet conveying unit in the media-sheet conveying direction in such a manner that a difference between an amount that the media sheet is conveyed by the media-sheet conveying unit and an amount that the media-sheet conveying unit is moved is kept constant;

a plurality of folding rollers that perform folding operation on the media sheet;

a media-sheet prestack path that is provided downstream of the folding rollers and capable of receiving and stacking the plurality of media sheets thereon;

a stopper that comes into contact with leading ends of media sheets delivered onto the media-sheet prestack path to block the media sheets; and a media-sheet retaining member that is pivotable in the media-sheet conveying direction and that comes into contact with trailing ends of the media sheets whose leading ends are in contact with the stopper and blocked, to thereby align the media sheets.

* * * * *